US005457981A

United States Patent [19]

Brown et al.

[11] Patent Number: 5,457,981

[45] Date of Patent: Oct. 17, 1995

[54] HEMMING PRESS

[75] Inventors: Gerald A. Brown, Trenton; William R. Hartley, Macomb; Mark P. Jehmlich, Detroit; Jeffrey S. McNamara, Grosse Ile; John C. Verzura, Sterling Heights, all of Mich.

[73] Assignee: Western Atlas, Inc., Warren, Mich.

[21] Appl. No.: 190,256

[22] Filed: Feb. 1, 1994

Related U.S. Application Data

[63] Continuation-in-part of Ser. No. 960,955, Oct. 14, 1992, abandoned.

[51] Int. Cl.[6] ..... B21D 39/02

[52] U.S. Cl. ..... 72/451; 72/403; 29/243.58

[58] Field of Search ..... 72/323, 319, 314, 72/315, 312, 450, 403, 451; 29/243.58

[56] References Cited

U.S. PATENT DOCUMENTS

| | | | |
|---|---|---|---|
| 2,847,051 | 8/1958 | Renard | 72/312 |
| 3,191,414 | 6/1965 | Kollar et al. | 72/48 |
| 3,276,409 | 10/1966 | St. Denis | 113/54 |
| 3,994,152 | 11/1976 | Wolters | 72/315 |
| 4,706,489 | 11/1987 | Dacey, Jr. | 72/450 |
| 5,005,398 | 4/1991 | Evans | 72/450 |
| 5,005,398 | 4/1991 | Evans | 72/450 |
| 5,083,355 | 1/1992 | Dacey, Jr. | 29/243.58 |

FOREIGN PATENT DOCUMENTS

| | | | |
|---|---|---|---|
| 686651 | 7/1930 | France | 72/323 |
| 1155414 | 10/1963 | Germany . | |
| 958671 | 5/1964 | United Kingdom . | |
| 1075663 | 7/1967 | United Kingdom . | |
| WO89/09101 | 10/1989 | WIPO | 72/403 |
| WO93/05902 | 4/1993 | WIPO | 72/403 |

OTHER PUBLICATIONS

Automobile Engineer—vol. 55, No. 3, Mar. 1965, pp. 110–113, "Clinching Machines".

*Primary Examiner*—Daniel C. Crane

*Attorney, Agent, or Firm*—Barnes, Kisselle, Raisch, Choate, Whittemore & Hulbert

[57] ABSTRACT

A press with both prehemming and final hemming tools or steels each driven by the same prime mover. Each steel is mounted on a separate carrier driven through separate toggle joints to advance and retract the steels for prehemming and final hemming of an upturned flange along an edge of a steel panel. To facilitate synchronizing the operation of at least two presses, the prime mover may be a screw and servo motor drive assembly.

24 Claims, 7 Drawing Sheets

HEMMING PRESS

REFERENCE TO A COPENDING APPLICATION

This is a continuation-in-part of application Ser. No. 07/960,955 filed Oct. 14, 1992, now abandoned.

FIELD OF THE INVENTION

This invention relates to hemming sheet metal and more particularly to an apparatus for forming a hem on an edge of a sheet of a structural sheet member such as a vehicle body panel.

BACKGROUND

Door, hood, and trunk deck lids of vehicles have been formed of one unitary outer skin of sheet metal joined around its periphery to a second inner reinforcing panel of sheet metal by hemming a generally upturned flange along each edge of the outer sheet over an adjacent edge of the inner panel.

This hemming has been accomplished in two separate stages. Prior to performing the first stage, the reinforcing panel is nested within the outer panel fixtured on an anvil die on a base of a prehemming machine. Upon fixturing the assembly, a tool of the machine, commonly referred to as a hemming steel, engages and bends an edge of the outer panel to an acute included angle with respect to the outer panel. After the prehemming of all edges to be joined, both panels are released, transferred to and fixtured in a second hemming machine where a second tool completely bends the prehemmed edge of the outer panel over the peripheral edge of the reinforcing panel to secure and attach the panels together as a unitary structural member for assembly on a vehicle.

Typically, a plurality of both prehemming and final hemming machines are respectively grouped around the periphery of a panel to perform all prehemming and hemming operations for one assembly either sequentially or substantially simultaneously. This type of hemming process and equipment has proven to be commercially successful and is still in widespread use.

However, this hemming process has disadvantages. Such a two stage hemming process is costly and inefficient by requiring multiple components, namely a prehemming machine, a transfer mechanism and a final hemming machine to perform the entire hemming assembly operation. Additionally, a considerable amount of tooling and transfer equipment is required for this type of process, it consumes a great deal of valuable manufacturing floor space and it increases the likelihood of equipment malfunction which can undesirably delay production. Furthermore, the process requires numerous steps to completely hem a single component. For example, the assembly must be fixtured, prehemmed, released, transferred, fixtured and final hemmed resulting in a low finished part production rate. Finally, this two stage process requires a relatively larger sheet flange depth which increases component weight and cost.

This two stage process is also susceptible to quality control problems. During transfer to the final hemming station, the panels may loosen from each other, become skewed with respect to each other, or not be properly located with respect to the final hemming station resulting in a finished hemmed assembly of lesser quality and poor structural integrity. An assembly with these characteristics may have to be repaired or scrapped, thereby increasing production costs and lowering profits. Even worse, an ill-assembled structural member with these flaws, if incorporated into an assembled vehicle may fit poorly and affect perceived quality by prospective purchasers, thereby reducing vehicle sales and profits. An assembled defective structural member may further lose integrity as the vehicle is subjected to road vibration during use and possibly require replacement and negatively impact an owners' future vehicle purchasing decision.

More recently, hemming machines have been designed which perform both the prehem and final hem operation in a single machine tool station which eliminates the need for a complex transfer mechanism. Hemming machines of this type vary in the kind of mechanism used and the manner of carrying out the hemming operations. Representative of these hemming machines are U.S. Pat. Nos.: Kollar et. al. 3,191,414; E. R. St. Denis 3,276,409; Dacey Jr. 4,706,489; and Dacey Jr. 5,083,355.

The hemming machines embodied in the Kollar '414 and E. R. St. Denis '409 patents are of similar construction and operation. Both patents disclose a pair of fluid powered drives carried by a frame of the machine for driving a single hemming steel through both the prehem and final hemming stages. Each machine utilizes one drive to control the sideward motion of the hemming tool toward the anvil and sheet during the prehem operation and a second drive for downwardly moving the tool to clinch the flange in a hem overlapping the structural reinforcing panel.

A disadvantage of the these single station prior art machines is that the hemming tool or steel continuously contacts the sheet edge during both stages of bending the flange which may produce undesirable distortion and highlighting in the sheet. A further drawback is that failure to maintain precise actuation sequencing of the first and second drives during hemming may result in the outer panel being defectively hemmed to the reinforcing panel causing the costly scrapping of the assembly. Furthermore, they have an abrupt motion of the hemming steel due to cam drives and high actuation forces. Also, the equipment to accurately sequence the actuation of each drive adds to the complexity of the machine, requiring additional costly maintenance while reducing reliability. Finally, the sequencing complexity of this type of hemmer limits the number of assemblies which may be produced during a given period of time.

Dacey Jr. '489 discloses a hemming machine utilizing a single drive and hemming steel connected by a complicated system of linkages and a cam and follower arrangement to perform both the prehem and final hem operations. Dacey Jr. '355 discloses a hemming machine having dual drives and a single hemming steel connected by a linkage and eccentric shaft arrangement to perform both the prehem and final hem operations.

A shortcoming of these prior art machines is that the hemming tool follows an arcuate sideways path, literally "wiping" the flange while prehemming the sheet edge which can introduce unwanted distortion or highlights in the outer panel adjacent the hem which are visual even after finishing and painting it. Moreover, the outer panel bends immediately adjacent the edge of the inner panel rather than at a predetermined desired break point which results in undesirable variations and inconsistencies from one panel assembly to another. The drive and sequencing mechanism is also complicated and requires frequent and costly production-delaying adjustments and is prone to unacceptable wear limiting the machines commercial usefulness.

SUMMARY OF THE INVENTION

A press for prehemming and final hemming a sheet received on an anvil with separate prehemming and final hemming tools or steels each driven through linkage powered by the same prime mover, such as a cylinder or a screw and servo motor. Each steel is mounted on a separate carrier or subframe pivotally mounted by links in a main frame and each driven through separate toggle joints to produce the force for bending the sheet by the steels. Preferably, to provide a more compact structure the prehem carrier is also eccentrically as well as pivotally mounted on the main frame. Preferably, the toggle joints are connected through rocker arms to the prime mover and the linkage provides a dwell in the movement of the prehemming steel so that it does not interfere with movement of the final hemming steel.

In another embodiment of this invention, to provide a simpler, more inexpensive prehem linkage with a more compact structure while being able to more precisely control prehemming steel speed, acceleration and dwell as well as the clearance between the two steels during press operation, the prehem toggle joint operably connects the final hemming steel carrier to the prehemming carrier and prehemming tool for more accurately synchronizing the prehemming tool with the final hemming tool.

Objects, features and advantages of this invention are to provide a combined prehemming and hemming press which eliminates highlights, provides a consistent break point in the outer panel, produces a hem with improved tolerances, requires only one prime mover to drive both the prehemming and hemming steels, utilizes mechanical linkage to sequence and synchronize the movement of both steels, enables speed, acceleration and dwell of the prehemming steel to be more precisely controlled allowing the use of larger steels to hem more complexly contoured workpieces, enables contoured workpieces to be hemmed about its periphery using a minimum of hemming presses, is of relatively compact construction making it easier to transfer panels into and out of a hemming press of this invention, is of relatively simple design, compact construction and arrangement and is rugged, reliable, durable, stable during operation, of economical manufacture and assembly, has a long useful life in service and requires relatively little maintenance and repair in use.

BRIEF DESCRIPTION OF THE DRAWINGS

These and other objects, features and advantages of this invention will be apparent from the following detailed description, appended claims and accompanying drawings in which:

DETAILED DESCRIPTION OF THE INVENTION

Figure 1:
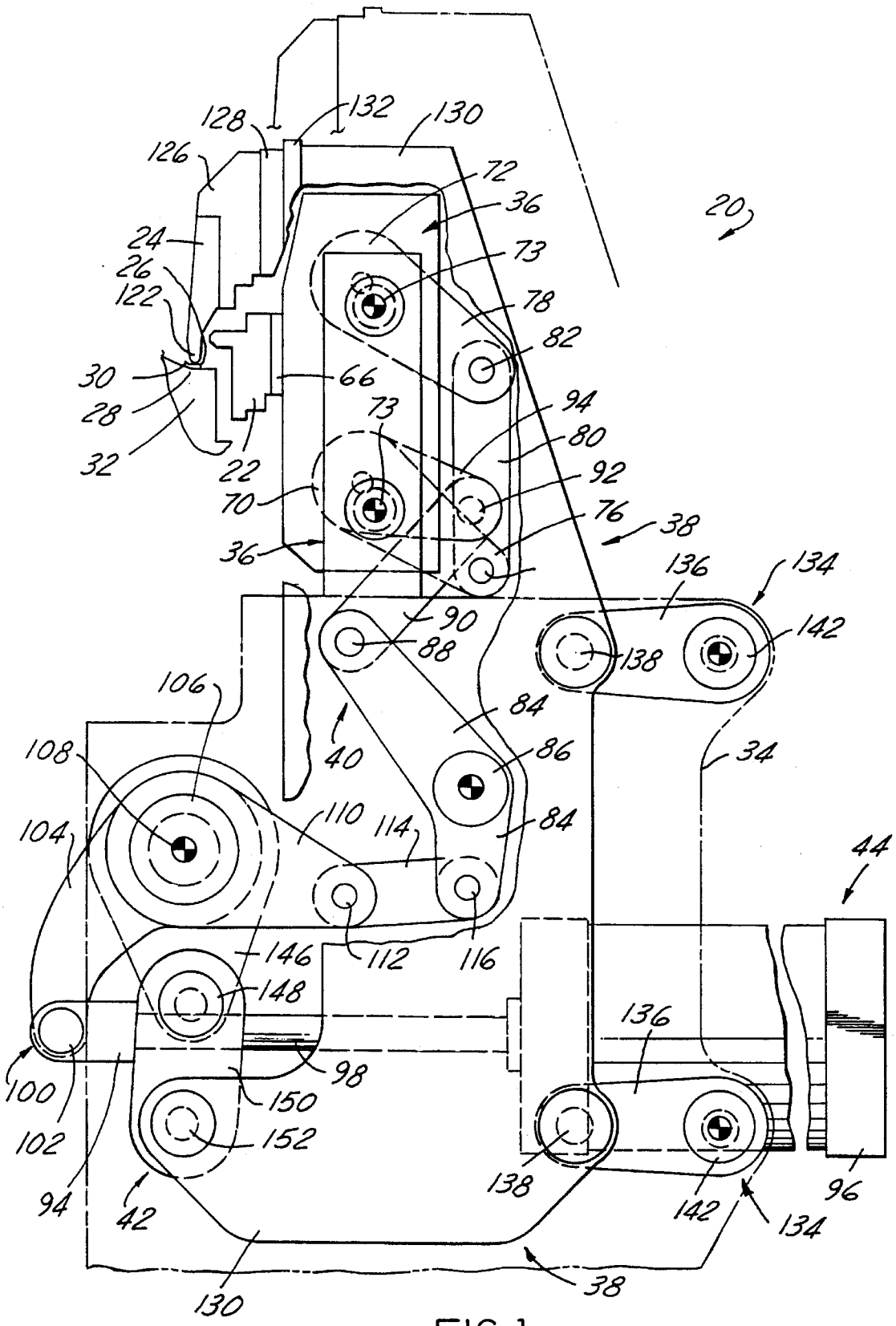
FIG. 1 is a fragmentary side view of a hemming press embodying this invention.
Figure 2:
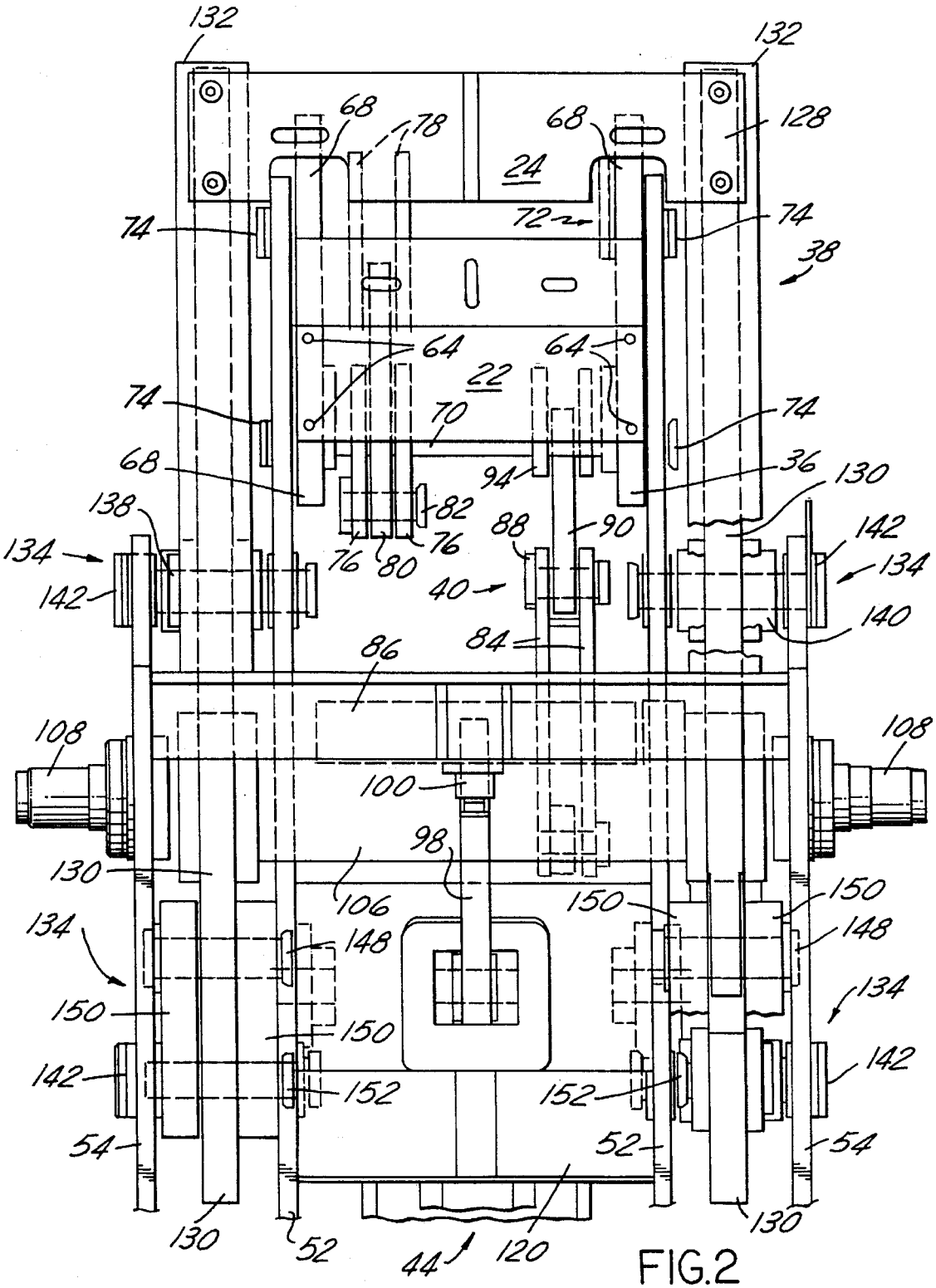
FIG. 2 is a fragmentary front view of the hemming press of FIG. 1.
Figure 3:
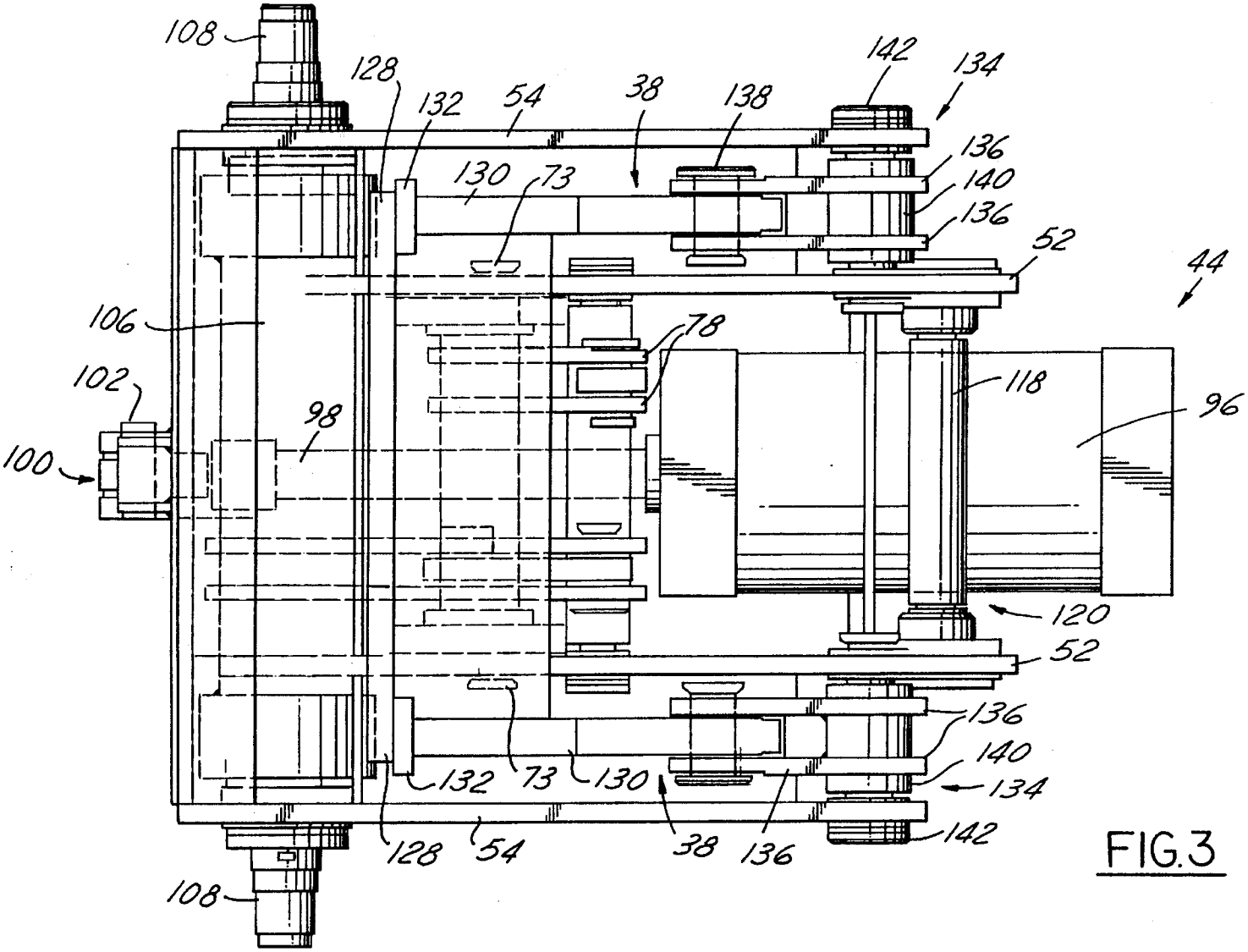
FIG. 3 is a top view of the hemming press.

Referring in more detail to the drawings, FIGS. 1–3 illustrate a hemming press 20 embodying this invention with a prehemming tool 22 and a hemming tool 24 for prehemming and final hemming an upright flange 26 along an edge 28 of a sheet metal panel 30. The edge 28 to be hemmed is supported by an anvil 32 fixed to a main frame 34. Each tool or steel 22 & 24 is received on a separate carrier or subframe 36 & 38 assembly mounted on the main frame 34. Each steel 22 & 24 is driven by a separate toggle linkage assembly 40 & 42, both of which are powered by a single prime mover 44, such as a fluid actuated cylinder assembly.

A single press 20 may be used to produce a finished hem along an edge of a single sheet or an edge of an outer panel of a nested assembly 46 of inner 48 and outer panels 50. However, frequently either two or four of these presses are arranged around the periphery of a sheet 30 or panel assembly 46 to either sequentially or simultaneously hem either two or four peripheral edges of the sheet 30 or assembly 46.

Frame

As shown in FIGS. 1 and 2, the main frame has two pairs of upright inner 52 and outer 54 or long and short upstanding support plates fixed at their lower ends to a base or a base plate (not shown). The prehemming carrier 36 is mounted on the inner plates 52 and the final hemming carrier 34 is mounted on all of the plates. Preferably, the anvil 32 is also supported by all of the plates.

For some applications, usually to facilitate insertion in, removal from and transfer of the panels through the press 20, it is pivotally mounted so it can be tilted by stub shafts fixed to the outer plates 54 and received in a cradle-like base (not shown).

Prehemming Tool

The prehemming steel 22 extends longitudinally the length of the flange to be hemmed 26 and, as shown in FIG. 1, has a horizontally projecting lip 58 with a downwardly and inwardly inclined face 60 which in use bears on the flange 26 to bend it over an adjacent portion of the sheet 30, usually to an acute included angle of about 35° to 55° and preferably about 45° . Preferably, the face 60 is inclined downwardly and inwardly at an angle of about 45° to the horizontal. Preferably, to limit the extent to which the steel 22 can be advanced toward the anvil 32, it is constructed so that its bottom edge bears on a shoulder 62 in the anvil 32 when the steel 22 is fully advanced by the press 20.

Prehemming Carrier

In use, the steel 22 is secured by cap screws 64 to a mounting plate 66 of the carrier or subframe assembly 36. The mounting plate 66 is fixed such as by welding to a pair of spaced apart and parallel side plates 68. The carrier 36 is pivotally mounted on the main frame 34 for movement in a generally arcuate path by a pair of torque tubes 70, 72 journalled for rotation by bearings 73 received in the side plates 68 and eccentrically mounted for pivotal movement on the main frame 34. Each tube 70, 72 is eccentrically mounted by stub shafts 74 journalled in bearings carried by the inner support plates 52 of the main frame. So that the torque tubes 70, 72 can be rotated in unison to advance and retract the carrier 36 and steel 22, a pair of spaced apart arms 76, 78 are fixed to each tube and connected by a link 80 and pivot pins 82 received in the arms.

Figure 4:
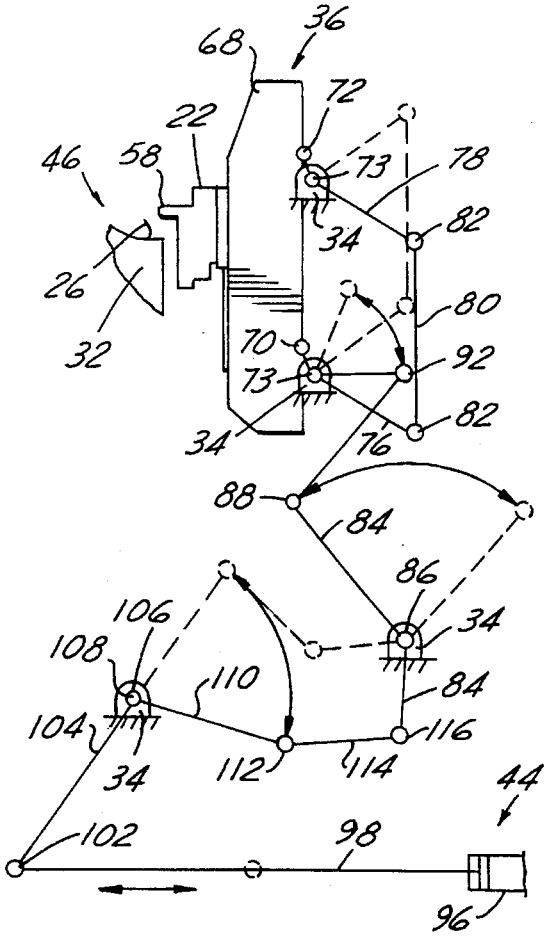
FIG. 4 is a kinematic diagram illustrating a prehemming tool and drive linkage of the press in a retracted position.

To provide the desired arcuate motion for the steel 22, as viewed in FIGS. 1 and 4, the eccentric pivot point for each stub shaft 74 of the tubes 70, 72 is in the lower right hand quadrant of the tube when the prehemming steel 22 and carrier 36 is in the fully retracted or raised position.

Figure 12:
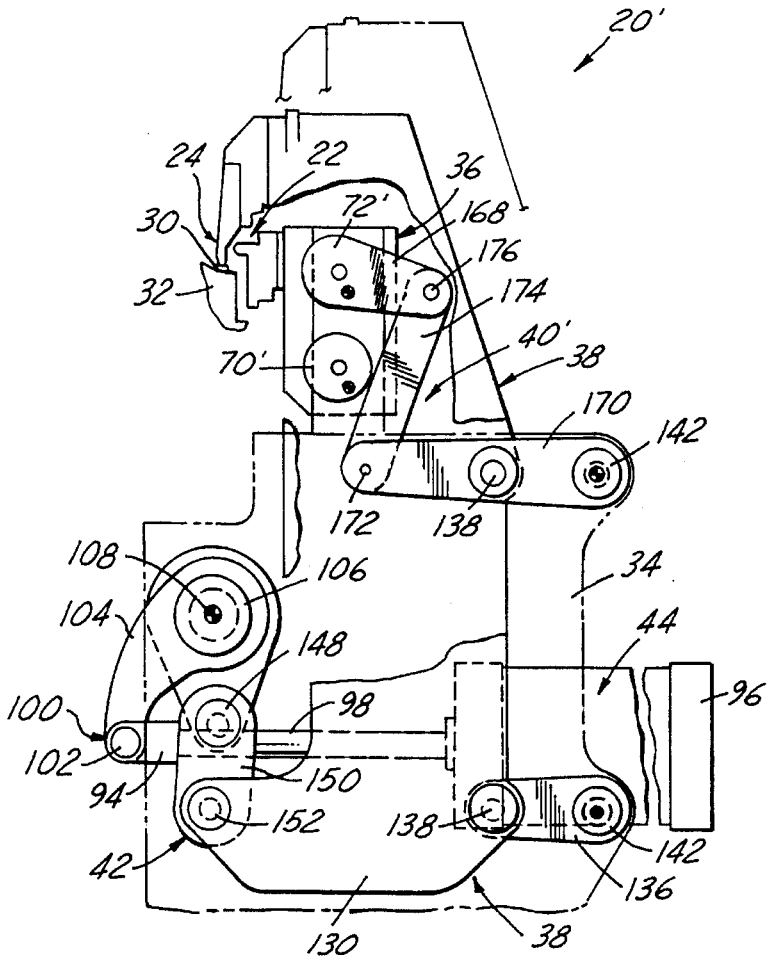
FIG. 12 is a fragmentary side view of a second hemming press of this invention.
Figure 13:
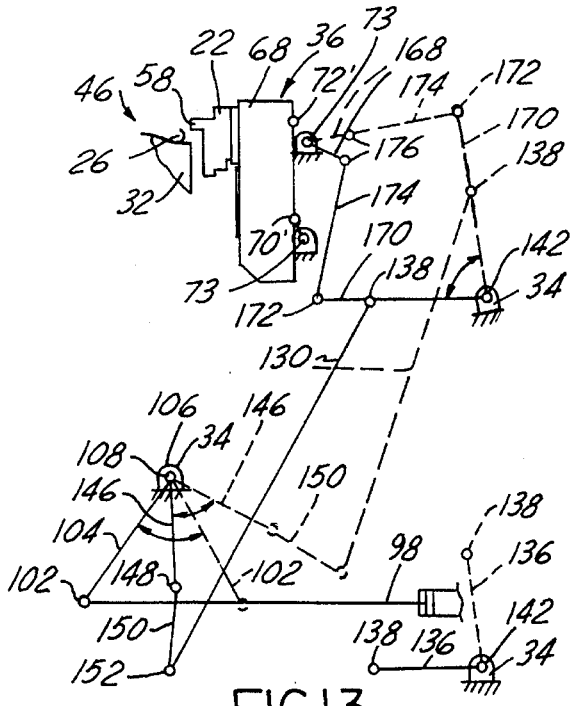
FIG. 13 is a kinematic diagram of the second hemming press illustrating the prehemming tool in a retracted position and its drive linkage both in an extended position shown in solid lines and in a retracted position shown in phantom lines.
Figure 14:
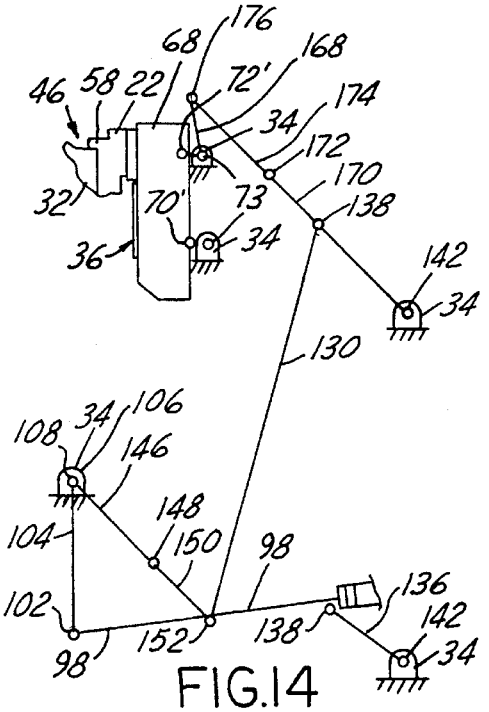
FIG. 14 is a kinematic diagram illustrating the prehemming tool in an extended position.

A second embodiment of a hemming press 20' of this invention is shown in FIGS. 12–14, and which also has the prehemming carrier pivotally mounted on the main frame 34 by a pair of torque tubes 70', 72' for facilitating movement of the prehemming steel 22 in a generally arcuate path. The prehemming carrier assembly of press 20' is essentially the same as press 20 except, for simpleness and compactness of construction, only the upper torque tube 72' has an arm 168 fixed to it for being driven by the prime mover 44 during press operation.

This arrangement of torque tubes, location of the eccentric pivot points, connecting arms and links provides a compact arrangement for mounting the prehemming carrier and steel. However, where a less compact arrangement is acceptable, a single torque tube could be utilized by locating the eccentric pivot points of its shaft in the upper right hand quadrant as viewed in FIGS. 1 and 4. This would eliminate the second torque tube 72 and the interconnecting link 80 and arms 76, 78.

Prehemming Toggle Joint

The carrier 36 and steel 22 are driven through a toggle joint assembly 40 which provides a mechanical advantage multiplying the force applied to the flange 26 of the sheet 30 as the steel 22 approaches its fully advanced position. The toggle assembly 40 has a pair of spaced apart arms 84 fixed to a shaft 86 journalled for rotation on the upright inner plates 52 of the frame 34 and pivotally connected by a pin 88 to one end of a link 90, the other end of which is received between and pivotally connected by a pin 92 to one end of a pair of arms 94 fixed to the lower torque tube 70.

Referring once again to FIGS. 12–14, the carrier 36 and prehemming steel 22 of press 20' are driven through a toggle joint assembly 40' that is in operable communication with the final hemming carrier assembly 38 for more directly synchronizing movement of the prehemming steel 22 with the final hemming steel 24 while, preferably, resulting in a press 20' of more compact construction and lower vertical profile making it easier to transport panel assemblies into a hemming work station. The toggle joint assembly 40' of press 20' functions essentially the same as toggle joint 40 of press 20 in translating movement of the prime mover 44 into movement of the prehemming steel 22 while replacing shaft 86, arms 84, and link 90 in direct communication with the prime mover 44 with linkage directly connecting the final hemming carrier 38 to the prehemming carrier 36 for providing a prehemming carrier 36 and toggle assembly 40' of reliable and stable operation. By driving the prehemming steel 22 through linkage directly operably connected to the final hemming carrier 38, both the prehemming steel 22 and final hemming steel 24 accelerate and decelerate at the same time during press operation making it easier to synchronize their movement and prevent them from interfering with each other.

The toggle joint assembly 40' has at least one first link 170 pivotally fixed to the frame 34 adjacent one end by a pin and bearing assembly 142 journalled in a bushing 140 and between its ends is pivotally connected by a pin 138 to one of the carrier side plates 130 of the final hemming carrier assembly 38. Adjacent its opposite end, the first link 170 is pivotally connected by a pin 172 to a second link 174 which in turn is pivotally connected by another pin 176 to the arm 168 of the upper eccentric 72'.

As is shown more clearly in FIGS. 13 & 14, the first link 170, second link 174 and eccentric arm 168 never become aligned during operation for preventing the prehemming toggle joint 40' from becoming unstable, thereby ensuring that the movement of the prehemming tool 22 is synchronized with the final hemming tool 24 so the press 20' does not jam and/or the steels don't collide with each other. Preferably, if desired, the lengths of the first link 170 and second link 174 may be varied relative to each other to adjust the dwell, speed and acceleration of the prehemming steel 22 as it moves toward and away from the anvil 32 of the press 20', control the clearance between the prehemming steel 22 and final hemming steel 24 during operation, and enable larger hemming steels to be used to extend further inwardly over the anvil 32 and panel 30 when hemming a panel 30 having a rather complex contour along its outer periphery without the steels colliding with each other. For example, to reduce the speed of the prehemming steel 22 as it approaches the anvil 32, the length of the first link 170 can be reduced.

Drive Assembly

The toggle joint 40 is powered by a drive assembly 44 having a single fluid, preferably air, actuated cylinder 96 connected through linkage to the toggle joint 40. A piston rod 98 of the cylinder is connected by a clevis 100 and pin 102 to one end of an arm 104 fixed to a drive torque tube 106 journalled for rotation by a pair of stub shaft and bearing assemblies 108 mounted on the outer plates 54 of the main frame 34. The toggle joint 40 is operably connected with the torque tube 106 through an arm 110 which is fixed at one end to the torque tube 106 and at the other end pivotally connected by a pin 112 to one end of a link 114, the other end of which is pivotally connected by a pin 116 to one end of the pair of arms 84 fixed to the shaft 86 of the toggle joint assembly 40. The housing of the cylinder 96 is pivotally mounted on the inner plates 46 of the main frame 34 by stub shaft and bearing assemblies 118 and a yoke 120 secured to the housing.

To avoid interference and provide clearance between the prehemming 22 and hemming 24 steels, preferably the prehemming steel 22 dwells in its retracted position while the hemming steel 24 is in its extended position, as shown in FIG. 1. This dwell is provided by the arcuate or circumferential location of the arm 110 on the torque tube 106 relative to the toggle assembly 40 when the piston rod 98 of the cylinder 96 is fully extended. With these components disposed in the position shown in FIG. 1, so that the axis of the arm 110 extends at an angle of about 15° below a line through the centers of the main tube 106 and the pivot pin 112, the prehemming steel 22 substantially dwells through about 30° of rotation of the torque tube 106 and arm 110 by the cylinder 96.

As is shown in FIGS. 12–14, the toggle joint 40' is powered through the final hemming carrier assembly 38 by the prime mover or drive 44. To avoid interference and provide clearance between the prehemming 22 and hemming 24 steels, the prehemming steel 22 dwells in its retracted position while the hemming steel 24 is in its extended position during final hemming of the flange 26, preferably such as is shown in FIGS. 12 & 13. This dwell is provided by the construction and arrangement of the first link 170, second link 174 and eccentric arm 168 of the toggle joint 40'. With these components disposed in the positions shown in FIGS. 12 & 13, the prehemming steel 22 will dwell when the piston rod 98 of the drive 44 is in its fully extended (shown in solid line in FIG. 13) and retracted (shown in phantom in FIG. 13) positions.

Final Hemming Tool

The final hemming steel 24 extends longitudinally the full length of the flange 26 to be hemmed and has a preferably slightly arcuate bottom face 122 which bears on the prehemmed flange 26 and bends it to the final fully hemmed position (FIG. 10), as the steel 24 is fully advanced by the press 20. Preferably, the steel 24 is removably received on a spacer plate 126 which is secured to a mounting plate 128 of the carrier assembly 38.

Final Hemming Carrier

As shown in FIGS. 1 and 2, the mounting plate 128 of the carrier assembly 38 is fixed to the upper end of the carrier or subframe assembly. The carrier 38 has a pair of spaced apart and parallel side plates 130 fixed by welds to spacer plates 132 disposed on their front edges.

The carrier is pivotally mounted on the main frame for generally arcuate movement by four link assemblies 134. Each link assembly has a pair of spaced apart arms 136 pivotally connected adjacent one end by a pin 138 to one of the carrier side plates 130 and fixed adjacent the other end to a bushing 140 journalled on a pin and bearing assembly 142 mounted on each pair of inner 52 and outer 54 plates of the main frame 34.

The final hemming carrier 38 of press 20' is essentially the same as press 20 except that at least one of the upper links 136 of the upper link assemblies 134 have been replaced with first link 170, as is shown in FIG. 12, which extends beyond pin 138 for transmitting movement of the final hemming carrier 38 to the prehemming carrier 36 through toggle joint 40'. In all other respects, the final hemming carrier 38 of press 20' is and operates the same as the final hemming carrier 38 of press 20.

Final Hemming Toggles

The final hemming carrier 34 and steel 24 are driven through a pair of toggle assemblies 42. Each toggle assembly 42 has an arm 146 fixed at one end to the main drive tube 106 and adjacent the other end pivotally connected by a pin and bearing assembly 148 to one end of a pair of toggle links 150, the other ends of which are pivotally connected by a pin and bearing assembly 152 to one of the side plates 130 of the carrier assembly.

Press operation

In a hemming cycle of the press 20, initially the piston rod 98 of the cylinder 96 is fully retracted which places both the prehemming steel 22 and the final hemming steel 24 in their fully raised and retracted positions. The assembly 46 of an outer panel 50 with an upturned flange 26 along an edge to be hemmed 28 over an adjacent edge of a reinforcing panel 48 nested therein is deposited on the anvil 32. Usually, a fixture is utilized to accurately locate the panel assembly on the anvil 32.

Figure 6:
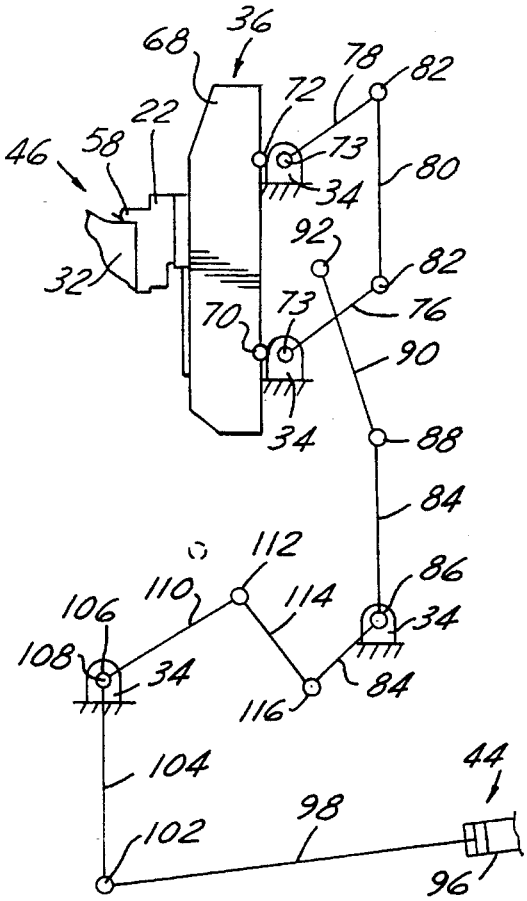
FIG. 6 is a kinematic diagram illustrating the prehemming tool and its drive linkage in an extended position.
Figure 5:
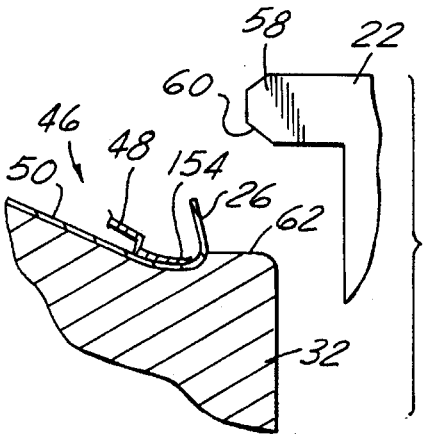
FIG. 5 is a fragmentary sectional side view of an anvil supporting a panel assembly and the prehemming tool in the retracted position of FIG. 4.
Figure 7:
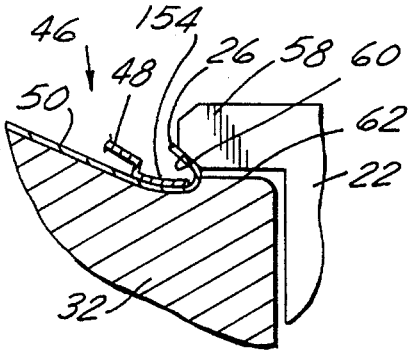
FIG. 7 is a fragmentary sectional side view of the anvil supporting the panel and the prehemming tool in the extended position of FIG. 6.

The prehemming operation is initiated by energizing the cylinder 96 to advance its piston rod 98. The hemming tool 22 and carrier 36 are moved downwardly in a generally arcuate path to bear on and bend the flange 26 from the position shown in FIG. 5 to that shown in FIG. 7 by movement of the drive linkage and toggle 40 from the position shown schematically in solid line in FIG. 4 to that shown in FIG. 6. As the toggle 40 moves to its mid point position (FIG. 6), it provides the maximum multiplication of the force produced by the cylinder 96 and applied to the steel 22 as the steel approaches its fully extended position to complete the prehemming bend of the flange 26.

To prevent distortion and highlighting of the panel adjacent the hem during bending, the curve of the generally arcuate movement of the steel 22 is designed to substantially eliminate relative sliding motion between the flange 26 and the inclined face 60 of the tool 22 as it forces the flange 26 into its prehemmed position. This is accomplished by constructing and arranging the eccentric mounting of the carrier 36 to produce a path of movement of the steel 22 complementary to that of the flange 26 during bending about its desired break point.

After the prehemming bend is completed, the steel 22 is retracted by continuing advancement of the cylinder piston rod 98 which continues to rotate the arm 84 of the toggle joint 40 clockwise (from the position shown in FIG. 6) to the position shown in phantom in FIG. 4. This movement of the toggle joint 40 rotates the carrier torque tubes 70, 72 clockwise which raises and thereby retracts the carrier 36 and hence the steel 22 along the generally arcuate path to its fully raised or retracted position.

The prehemming operation of press 20', as is illustrated more clearly by the kinematic diagrams in FIGS. 13 & 14, is initiated by energizing the cylinder 96 to advance its piston rod 98 from the position shown in phantom in FIG. 13 toward the position shown in solid line to move the prehemming steel 22 from its dwell position, to permit unloading and loading of a panel assembly 46 onto the anvil 32, to an extended position (FIG. 14), where it bends the flange 26 of the panel to a prehem position, and later return the steel to a dwell position to permit the final hemming steel 24 to final hem the flange 26.

As the cylinder 96 rotates the torque tube 106 clockwise, its arm 146 and toggle links 150 lower the final hemming carrier side plates 130 about pivot points 142. With the movement of the side plates 130, the first link 170 of the prehem toggle joint 40' rotates clockwise about pivot pin and bearing assembly 142 from the position shown in phantom in FIG. 13 toward the position shown in FIG. 14 moving the prehemming steel 22 in a generally arcuate motion toward the panel 46 and anvil 32. When the first link 170 reaches the position shown in FIG. 14 and is substantially aligned with the second link 174, the toggle joint 40' provides the maximum multiplication of force produced by the cylinder 96 and applied by the steel 22 as it engages the flange 26 and bends it to the prehem position.

With further rotation of the torque tube 106 toward the position shown in solid line in FIG. 13, the prehemming steel 22 is retracted from the anvil 32 toward the dwell position shown to provide clearance for the final hemming steel 24 to move toward the anvil 32 and engage the flange 26 to complete the hem.

Figure 8:
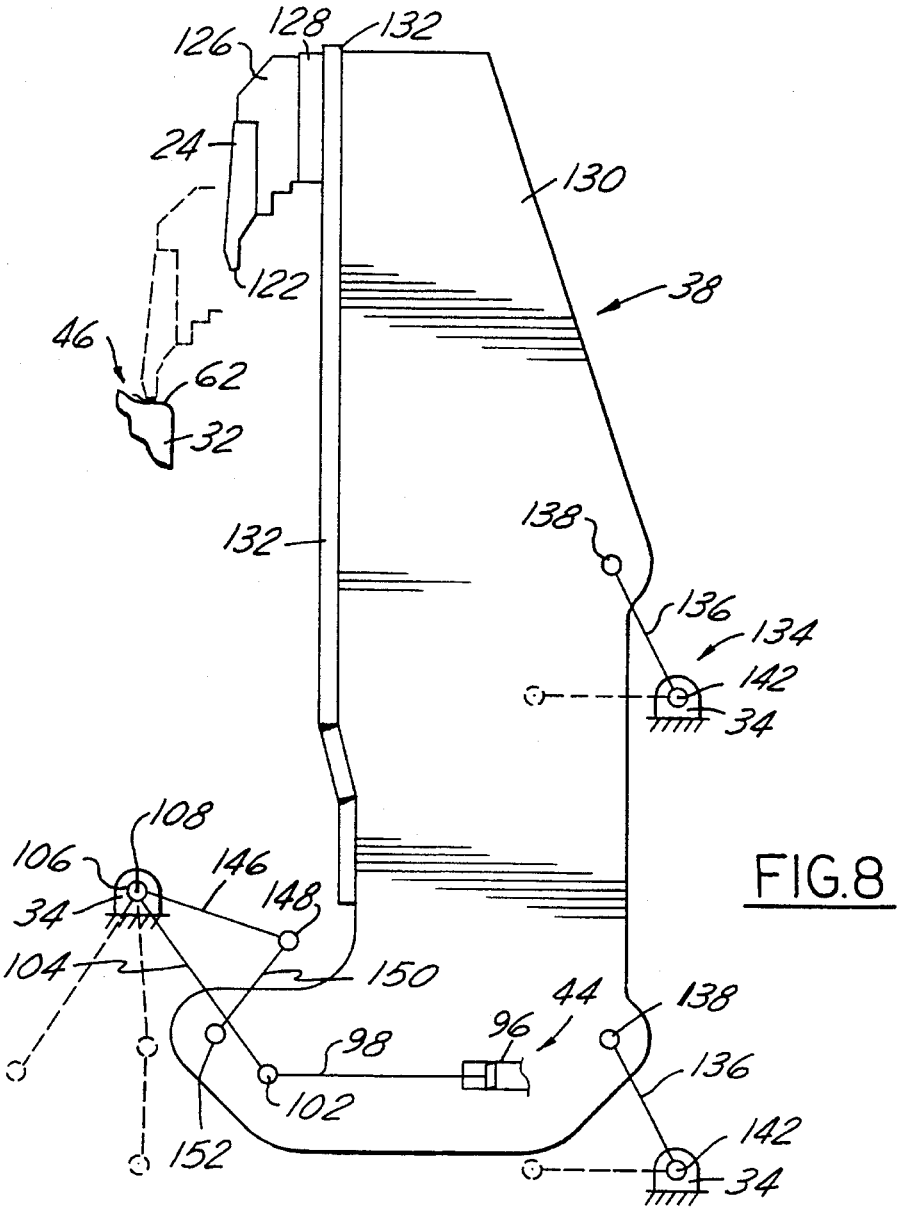
FIG. 8 is a kinematic diagram illustrating a final hemming tool and its drive linkage in a retracted position in solid lines and in an extended position in phantom lines.
Figure 9:
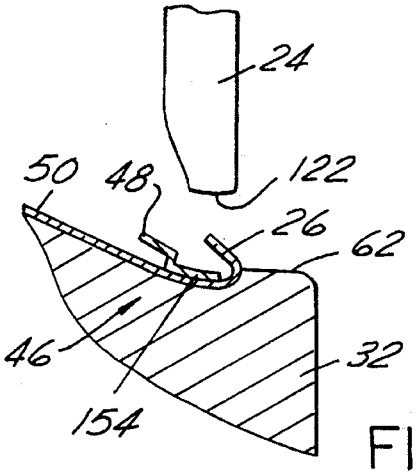
FIG. 9 is a fragmentary sectional side view of the final hemming tool adjacent the prehemmed edge of the sheet on the anvil.
Figure 10:
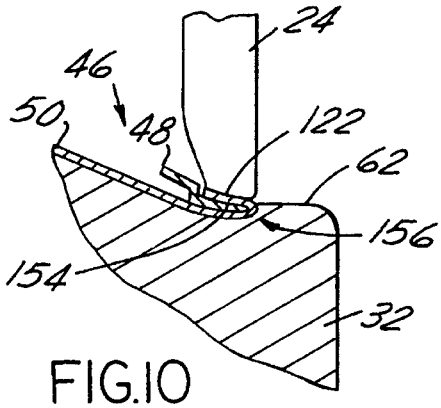
FIG. 10 is a fragmentary sectional side view of the final hemming tool in a final hem position having formed a return bend in the outer sheet and forced the flange into overlapping engagement with the edge of the inner sheet of the panel assembly received on the anvil.

By the advancement of the cylinder rod 98, the carrier 38 and hence the final hemming steel 24 is also lowered or advanced in a generally arcuate path from the solid line to the phantom line positions shown in FIG. 8 to bear on the prehemmed flange 26 and bend it into the fully hemmed position, shown in FIG. 10, to form a return bend with the flange 26 overlying and firmly engaging an edge 154 of the inner panel 48. As shown in FIG. 8, the clockwise rotation of the drive tube 106 moves the toggle joints 144 from the solid line position to the phantom line position in which the toggle joints 144 approach their respective mid points m to thereby lower or advance the steel 24 to its fully extended position. As the toggle joints 144 approach their mid point position m, they produce the greatest multiplication of the force produced by the cylinder 96 and applied to the steel 24 as the steel approaches its fully advanced position to complete the bend and force the flange 26 into firm engagement with the underlying edge 154 of the reinforcing panel 48 to complete the hem 156.

To prevent distortion and highlighting of the panel during final hemming, even though the carrier 38 and steel 24 move in an arcuate path, as the flange 26 approaches its fully hemmed position (FIG. 10), the associated segment of the path is substantially at a right angle to the plane of the final fully hemmed position of the flange 26 and there is substantially no relative lateral movement between the flange 26 and the face 122 of the tool 24 bearing the flange 26. This is achieved by the construction and arrangement of the pivotal link assemblies 134 so that (as shown in FIG. 8) when the steel 24 approaches the fully hemmed position there is substantially no lateral movement of the carrier 38 and steel 24 due to the portion of the arc in which the pivot link assemblies 134 are moving in which (as shown in phantom FIG. 8) the longitudinal axis through their pivot points extends substantially parallel to the plane of the flange 26 when in its fully hemmed position.

After the finished hem is completed, the steel 24 is retracted by actuating the cylinder 96 to move its piston rod 98 to the fully retracted position. This rotates the main tube 106 counter-clockwise (as viewed in FIGS. 1, 4, 6, and 8), which through the associated linkage and toggle joints, retracts and raises both carriers 36, 38 and their associated steels 22, 24 to their fully retracted positions. As will be apparent, while the main steel 24 is being raised and retracted, the prehemming steel 22 will be initially again moved to its advanced position and then retracted. However, since the hem 156 has already been completed, the prehemming steel 24 will not strike it when it is advanced.

Multiple Presses

In some applications, it may be desirable to arrange two or more presses to operate simultaneously or sequentially for hemming different edges on the same panel assembly while it is received in a fixture. For example, a generally rectangular hood assembly may have an outer panel with upturned flanges along all four sides to be hemmed. This panel assembly could be received on a fixture disposed between four hemming presses each positioned to hem one of the flanges of the hood panel assembly. To minimize the tendency of the panel being forced during hemming to shift or move relative to the fixture, all four edges of the panel could be prehemmed and final hemmed simultaneously. Alternatively, one pair of generally opposed flanges can be prehemmed and hemmed simultaneously by two of the presses and thereafter the other opposed pair of flanges can be prehemmed and hemmed simultaneously by the other two presses.

Where at least two presses are operated simultaneously or in a rapid sequence, it is preferred to utilize as the prime mover for each press a screw and servo motor 158 in lieu of a fluid actuated cylinder. This servo motor and screw drive 158 provides a more accurate and precise control of the cycle of each press which facilitates synchronizing the cycle and operation of two or more presses.

Figure 11:
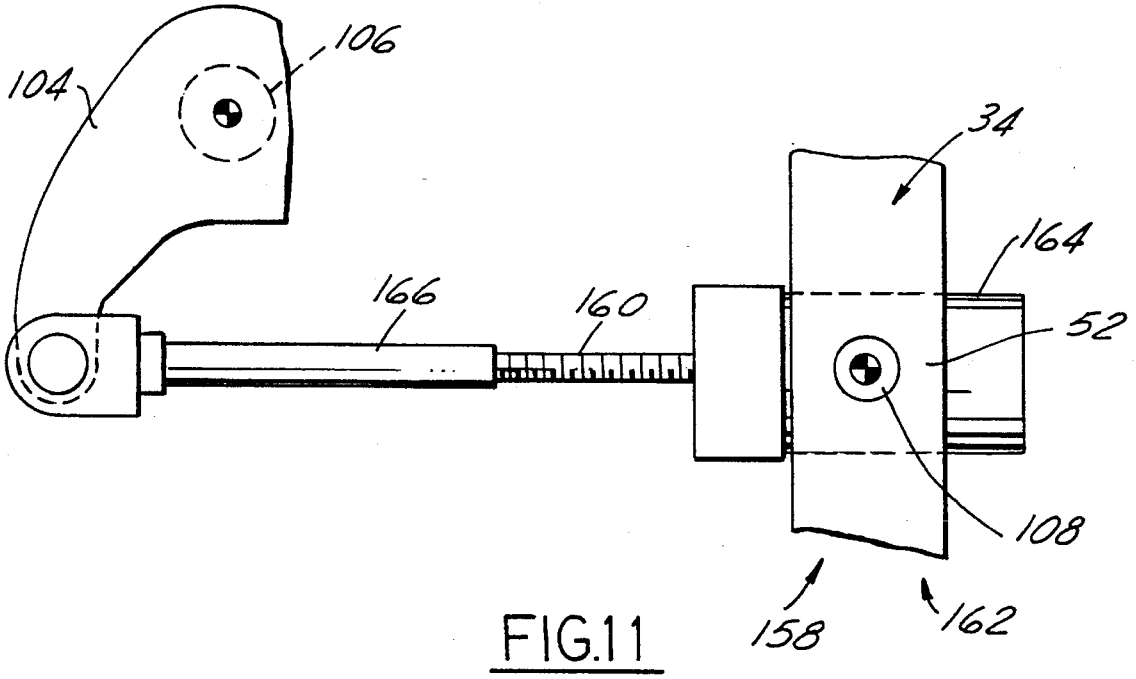
FIG. 11 is a fragmentary side view of a screw drive and servo motor operably connected with a crank arm of the hemming press of FIG. 1.

FIG. 11 illustrates a suitable screw and servo motor prime mover 158 with a screw 160 journalled for rotation in a housing 162 and driven by a reversible servo motor 164 which is preferably a stepper motor. The housing is pivotally mounted on the main frame 34 by a pair of stub shaft bearing assemblies 108 secured to the upright inner plates 52 of the frame 34. A traveling nut 166, preferably with recirculating ball bearings, is received on the screw 160 and pivotally connected to a pair of arms 104 fixed to the main drive tube 106. The use of a servo motor 164 also facilitates manual "jogging", by controlled stepping or manual cycling of a press for setup, maintenance and repair purposes, such as when installing, adjusting or changing the prehemming 22 and hemming steels 24.

What is claimed is:

1. A press for hemming an edge of a sheet, comprising:

a frame;

an anvil carried by said frame for receiving and supporting an edge of a sheet to be hemmed;

a first subframe carried by said frame for movement relative thereto;

a first hemming tool carried by said first subframe for bending a flange adjacent an edge of the sheet to a prehem position;

a second subframe carried by said frame for movement relative thereto;

a second hemming tool carried by said second subframe for bending the flange of the sheet from the prehem position to a hem position having a return bend and overlapping the sheet;

a drive operably connected with said first subframe for moving said first hemming tool to bend the flange of the sheet to the prehem position and operably connected with said second subframe for moving said second hemming tool to bend the flange of the sheet to the hem position;

at least one eccentric movably mounting said first subframe on said frame for generally arcuate reciprocating motion; and an arm fixed to said eccentric and operably connected with said drive to turn said eccentric to move said first subframe and said first hemming tool in a generally arcuate motion toward said anvil and the flange of the sheet and generally downwardly when bending the flange of the sheet to the prehem position.

2. The press of claim 1 also comprising at least two eccentrics spaced apart and mounting said first subframe on said frame and operably connected with said drive for being turned in unison to move said first subframe in a generally arcuate motion toward said anvil and the flange of the sheet and generally downwardly when bending the flange of the sheet to the prehem position.

3. The press of claim 1 also comprising an arm fixed to each eccentric and a link pivotally connected to each said arm.

4. The press of claim 2 also comprising another arm fixed to one of said eccentrics and operably connected with said drive.

5. The press of claim 1 wherein said first hemming tool has a beveled forward face for engaging the flange of a sheet to bend the flange to the prehem position.

6. The press of claim 1 wherein said first hemming tool engages the flange of a sheet to bend it to an acute included angle with respect to the sheet when bending the flange to the prehem position.

7. The press of claim 1 wherein said first hemming tool engages the flange of a sheet to bend it to an acute included angle of about 35° to 55° with respect to the sheet when bending the flange to the prehem position.

8. The press of claim 1 wherein said second hemming tool engages the flange of the sheet and bends it to have a return bend with the flange overlapping the sheet.

9. The press of claim 1 also comprising at least one toggle joint operably connected with said first subframe and said drive for driving said first hemming tool and multiplying the force applied to the flange of the sheet through said first tool by said drive when said first tool engages and bends the flange.

10. The press of claim 1 also comprising said second subframe having a pair of spaced apart support plates carrying said second hemming tool, at least two links pivotally connected to said frame and said second subframe for generally arcuate reciprocating motion and said second subframe being operably connected with said drive for moving said second subframe and second hemming tool to bend a flange of the sheet from the prehem position to a final hem position having a return bend and the flange overlapping the sheet.

11. The press of claim 1 also comprising said second subframe having a pair of spaced apart support plates carrying said second hemming tool, at least two links pivotally connected to said frame and said second subframe for generally arcuate reciprocating motion, a drive link pivotally connected to said second subframe and operably connected with said drive for moving said second subframe and second hemming tool to bend a flange of the sheet from the prehem position to a final hem position having a return bend and the flange overlapping the sheet.

12. The press of claim 1 also comprising said second subframe having a pair of spaced apart support plates carrying said second hemming tool, at least two spaced apart links pivotally connected to each of said support plates of said second subframe and pivotally connected to said frame for generally arcuate reciprocating motion of said subframe and said tool, a pair of drive links pivotally connected to each plate of said subframe and operably connected with said drive for moving said second subframe and second hemming tool to bend a flange of the sheet from the prehem position to a final hem position having a return bend and the flange overlapping the sheet.

13. The press of claim 1 which also comprises a toggle joint operably connecting said second subframe to said eccentric.

14. The press of claim 13 wherein said toggle joint comprises a first link pivotally operably connected to said frame and said second subframe, a second link pivotally operably connected to said first link, and an arm fixed to said eccentric pivotally operably connected to said second link moving said first subframe and said first hemming tool in a generally arcuate motion toward said anvil and the flange of the sheet and generally downwardly when bending the flange of the sheet to the prehem position.

15. The press of claim 14 wherein the length of said arm fixed to said eccentric and said second link can be viewed relative to each other to control the speed and acceleration of the motion of said first hemming tool as well as clearance between said first hemming tool and said second hemming tool during press operation.

16. The press of claim 1 wherein said eccentric comprises a single eccentric operably connected with said drive.

17. A press for hemming an edge of a sheet, comprising:

a frame;

an anvil carried by said frame for receiving and supporting an edge of a sheet to be hemmed;

a first subframe, a pair of first links each at a first point pivotally carried by said frame and at a second point spaced from said first point pivotally connected to said first subframe for generally arcuate movement of said first subframe relative to said frame;

a first hemming tool carried by said first subframe for bending a flange adjacent an edge of the sheet to a prehem position;

a second subframe, a pair of second links each at a third point pivotally carried by said frame and at a fourth point spaced from said third point pivotally connected to said second subframe for generally arcuate movement of said second subframe relative to said frame;

a second hemming tool carried by said second subframe for bending the flange of the sheet from the prehem position to a hem position having a return bend and overlapping the sheet;

a drive operably connected with said first subframe for moving said first hemming tool to bend the flange of the sheet to the prehem position and operably connected with said second subframe for moving said second hemming tool to bend the flange of the sheet to the hem position; and said first points of said pair of first links being spaced apart on a first straight line, said third points of said pair of second links being spaced apart on a second straight line which is spaced from and substantially parallel to said first straight line, at least one toggle joint operably connected with said first subframe and said drive and having a first toggle link pivotally carried by said frame and operably associated with said drive, a second toggle link pivotally connected adjacent one end to said first toggle link and adjacent the opposite end operably pivotally connected with said first subframe for advancing said first tool as said first and second toggle links approach a midpoint of displacement where said first and second toggle links are generally longitudinally aligned, multiplying the force applied by said first tool to the flange of the sheet when said first and second toggle links are adjacent the midpoint and generally aligned with each other to fully extend said first tool, and for retracting said first tool from the sheet as said first and second toggle links are moved away from the midpoint.

18. A press for hemming an edge of a sheet, comprising:

a frame, an anvil carried by said frame for receiving and supporting an edge of a sheet to be hemmed;

a first subframe, a pair of first links each at a first point pivotally carried by said frame and at a second point spaced from said first point pivotally connected to said first subframe for generally arcuate movement of said first subframe relative to said frame;

a first hemming tool carried by said first subframe for bending a flange adjacent an edge of the sheet to a prehem position;

a second subframe, a pair of second links each at a third point pivotally carried by said frame and at a fourth point spaced from said third point pivotally connected to said second subframe for generally arcuate movement of said second subframe relative to said frame;

a second hemming tool carried by said second subframe for bending the flange of the sheet from the prehem position to a hem position having a return bend and overlapping the sheet;

a drive operably connected with said first subframe for moving said first hemming tool to bend the flange of the sheet to the prehem position and operably connected with said second subframe for moving said second hemming tool to bend the flange of the sheet to the hem position;

said first points of said pair of first links being spaced apart on a first straight line, said third points of said pair of second links being spaced apart on a second straight line which is spaced from and substantially parallel to said first straight line, at least one first toggle joint operably connected with said first subframe and said drive and having a first toggle link pivotally carried by said frame and said drive, a second toggle link pivotally connected adjacent one end to said first toggle link and adjacent the opposite end operably pivotally connected with said first subframe for advancing said first tool as said first and second toggle links approach a midpoint of displacement wherein in said first and second toggle links are generally longitudinally aligned, multiplying the force applied by said first tool to the flange of the sheet when said first and second toggle links are adjacent the midpoint and generally longitudinally aligned with each other to fully extend said first tool and for retracting said first tool from the sheet as said first and second toggle links are moved away from the midpoint, at least one second toggle point operably connected with said second subframe and said drive and having a third toggle link pivotally carried by said frame and operably associated with said drive, a fourth toggle link pivotally connected adjacent one end to said third toggle link and adjacent the opposite end operably pivotally connected with said second subframe for advancing said second tool as said third and fourth toggle links approach a midpoint of displacement wherein said third and fourth toggle links are generally longitudinally aligned, multiplying a force applied by said second tool to the flange of the sheet when said third and fourth toggle links are adjacent their midpoint and generally longitudinally aligned with each other to fully extend said second tool and for retracting said second tool from the sheet as said third and fourth toggle links are moved away from their midpoint, and said first and second toggle points are constructed and arranged so that when one of said toggle joints is at its midpoint of displacement the other of said toggle joints is generally distal from its midpoint of displacement.

19. The press of claim 18 wherein said drive comprises a fluid actuated cylinder.

20. The press of claim 18 wherein said drive comprises a screw operably connected to a servomotor.

21. A press for hemming an edge of a sheet, comprising:

a frame;

an anvil carried by said frame for receiving and supporting an edge of a sheet to be hemmed;

a first subframe carried by said frame for movement relative thereto;

a first hemming tool carried by said first subframe for bending a flange adjacent an edge of the sheet to a prehem position;

a second subframe carried by said frame for movement relative thereto;

a second hemming tool carried by said second subframe for bending the flange of the sheet from the prehem position to a hem position having a return bend and overlapping the sheet;

a drive operably connected with said first subframe for moving said first hemming tool to bend the flange of the sheet to the prehem position and operably connected with said second subframe for moving said second hemming tool to bend the flange of the sheet to the hem position; and a tube journalled for rotation and carried by said frame, at least two circumferentially spaced apart arms fixed to said tube, a dwell link at one end pivotally operably connected with said first subframe and at the opposite end pivotally connected to one arm of said tube for retaining said first tool in a position retracted from said anvil when said link and said arm of said tube are generally longitudinally aligned with each other while said second tool is advanced toward said anvil and engaged with the flange to bend the flange from the prehem position to the hem position with the flange having a return bend and overlapping the sheet.

22. A press for hemming an edge of a sheet, comprising:

a frame an anvil carried by said frame for receiving and supporting an edge of a sheet to be hemmed;

a first subframe carried by said frame for movement relative thereto;

a first hemming tool carried by said first subframe for bending a flange adjacent an edge of the sheet to a prehem position;

a second subframe carried by said frame for movement relative thereto;

a second hemming tool carried by said second subframe for bending the flange of the sheet from the prehem position to a hem position having a return bend and overlapping the sheet;

a drive operably connected with said first subframe for moving said first hemming tool to bend the flange of the sheet to the prehem position and operably connected with said second subframe for moving said second hemming tool to bend the flange of the sheet to the hem position; and said second subframe having a pair of spaced apart support plates carrying said second hemming tool, at least two links pivotally connected to each plate and pivotally carried by said frame for generally arcuate reciprocating motion of said second subframe and tool and supporting said second subframe, a tube journalled for rotation and carried by said frame, at least two arms fixed to said tube, a pair of toggle links each pivotally connected to an arm of said tube and pivotally connected to a plate of said second subframe for advancing said second tool as said toggle links and arms approach a midpoint of displacement where each of said links is generally aligned with its respective arm, and multiplying the force applied by said second tool to the flange of the sheet when said toggle links are adjacent the midpoint for bending a flange of the sheet from the prehem position to a final hem position having a return bend and the flange overlapping the sheet.

23. The press of claim 22 which also comprises a first toggle operably connected with said first subframe and said drive for driving said first hemming tool and multiplying the force applied to the flange of the sheet through said first tool by said drive when said first tool engages and bends the flange to a prehem position and a second toggle operably connected with said second subframe and said drive for driving said second hemming tool and said second tool by said drive when said second tool engages and bends the flange from the prehem position to a final hem position having a return bend and the flange overlapping the sheet.

24. The press of claim 22 which also comprises a first toggle operably connected with said first subframe and said drive for driving said first hemming tool and having a midpoint of displacement where the force applied to the flange of the sheet through said first tool by said drive when said first tool engages and bends the flange to a prehem position is multiplied, and a second toggle operably connected with said second subframe and said drive for driving said second hemming tool and having a midpoint of displacement where the force applied to the flange of the sheet through said second tool by said drive when said second tool engages and bends the flange from the prehem position to a final hem position having a return bend and the flange overlapping the sheet is multiplied, and arranged and constructed so that when one of said toggles is at a midpoint of displacement the other toggle is generally distal from its midpoint.

* * * * *